US005237822A

United States Patent [19]

Rathbone

[11] Patent Number: 5,237,822

[45] Date of Patent: Aug. 24, 1993

[54] AIR SEPARATION

[75] Inventor: Thomas Rathbone, Surrey, England

[73] Assignee: The BOC Group plc, Windlesham, England

[21] Appl. No.: 819,257

[22] Filed: Jan. 10, 1992

[30] Foreign Application Priority Data

Jan. 15, 1991 [GB] United Kingdom ..... 9100814

[51] Int. Cl.[5] ..... F25J 3/02

[52] U.S. Cl. ..... 62/25; 62/38

[58] Field of Search ..... 62/11, 24, 38, 39, 40, 62/25

[56] References Cited

U.S. PATENT DOCUMENTS 4,222,756 9/1980 Thorogood ..... 62/38
4,303,428 12/1981 Vandenbussche ..... 62/38
4,746,343 5/1988 Ishizu et al. ..... 62/38

*Primary Examiner*—Ronald C. Capossela
*Attorney, Agent, or Firm*—David M. Rosenblum; Larry R. Cassett

[57] ABSTRACT

Air is compressed in a compressor and has water vapor and carbon dioxide removed therefrom in an apparatus. A portion of the resulting purified air is then cooled by passage through a main heat exchanger to a temperature suitable for its separation by rectification. The air is then introduced into the higher pressure stage of a double rectification column (which also has a lower pressure stage). Liquid oxygen is withdrawn from the lower pressure stage by a pump and is vaporized by passage through the heat exchanger countercurrently to the aforementioned air to form a high pressure gaseous oxygen product. A second portion of the purified air is further compressed in compressors and is then passed through the heat exchanger 6 countercurrently to the oxygen product, thereby helping to warm such product. A part of the first portion of air is withdrawn from an intermediate region of the heat exchanger, is expanded in a turbine and is introduced into the lower pressure rectification stage. A part of the second portion of the air is taken from intermediate the compressors and is passed through the heat exchanger, being withdrawn therefrom at an intermediate location thereof. This air stream is then expanded in an expansion turbine and is passed into the higher pressure rectification stage of the column.

8 Claims, 3 Drawing Sheets

AIR SEPARATION

BACKGROUND OF THE INVENTION

This invention relates to air separation. In particular, it relates to an air separation process and apparatus in which a liquid oxygen stream is withdrawn from a rectification column, is pressurized, and is then vaporized to form a high pressure, gaseous oxygen, product stream. Such processes are often referred to as 'liquid pumping' processes.

Such a process may, for example, be used to provide high pressure oxygen for the manufacture of synthetic fuel gases or for the gasification of coal. By using a pump to pressurize liquid oxygen withdrawn from the rectification column, the use of an oxygen compressor is avoided. Since oxygen compressors are expensive and can be hazardous to operate, it is particularly desirable to avoid their use, and for this reason oxygen production processes using a liquid pump to withdraw oxygen in the liquid state from a rectification column find particular favor in commercial practice. Nonetheless, such processes involving the use of liquid oxygen pumping do have certain drawbacks. Suppose, for example, the oxygen product is required at a pressure of 50 atmospheres absolute (5 MPa). In order to effect vaporization of the liquid oxygen it is normal to pass it through a heat exchanger countercurrently to a stream of fluid taken from the incoming air or the nitrogen product of the process. It is desirable to maintain the specific enthalpy-temperature profile of the heat exchange stream in close conformity with that of the liquid oxygen stream being vaporized. As the temperature of the liquid oxygen stream rises, so its specific enthalpy increases. The rate of change in the change in specific enthalpy with temperature becomes progressively greater until a first maximum is reached. The specific enthalpy then increases sharply with temperature until a second maximum rate of change in the change of specific enthalpy with temperature is reached. The rate of change of specific enthalpy of the oxygen with temperature then becomes less marked. When the oxygen is at a pressure below its critical pressure, the two maxima occur at the same temperature and represent the start and finish of vaporization of the oxygen. When the oxygen is above its critical pressure, the two maxima occur at two different temperatures. The heat exchange stream also has a specific enthalpy-temperature profile with two maxima. In order best to "fit" the specific enthalpy-temperature profile of the oxygen stream being warmed with that of the heat exchange stream being cooled, the first or lower temperature maximum of the heat exchange stream should be at a temperature a few degrees K below that of the oxygen stream being warmed. This consideration imposes a requirement that the pressure of the heat exchange stream should be more than twice that of the pressure to which the liquid oxygen stream is raised. Accordingly, when the oxygen stream is required at a pressure of 50 atmospheres absolute (5 MPa), the heat exchange stream, if it is air or nitrogen, needs to be at a pressure of more than 100 atmospheres absolute. Conventional plate-fin heat exchangers cannot safely withstand such high pressures. Accordingly, the heat exchange between the liquid oxygen stream and the heat exchange stream is performed in a separate heat exchanger in parallel with a plate-fin heat exchanger used to cool a major portion of the incoming air to a temperature suitable for its separation by rectification. The parallel heat exchanger is typically of the "spiral-wound" kind. Such heat exchangers are able to withstand very high operating pressures, but are relatively expensive to fabricate. Moreover, to produce pressures in excess of 100 atmospheres absolute (10 MPa) it is generally necessary to use reciprocating rather than rotary compressors. Such reciprocating compressors are expensive, inefficient and prone to failure. GB-A-2 079 428 and GB-A-2 080 929 disclose complex liquid pumping processes which avoid the use of such high pressures in the heat exchange streams but which use an arrangement of two parallel heat exchangers each having a warm end operating at or close to ambient temperature and a cold end operating at cryogenic temperatures.

SUMMARY OF THE INVENTION

It is accordingly an aim of the present invention to provide a method and apparatus for separating air in which a stream of liquid oxygen is withdrawn from a rectification column used to separate the air, and the stream is pressurized by operation of a pump and is then vaporized by countercurrent heat exchange with a stream comprising air, wherein the pressure of the heat exchange stream is able to be kept well below a value of twice the pressure to which the liquid oxygen stream is raised, said value typically not being greater than 100 atmospheres (10 MPa) and wherein there is no requirement for a complex arrangement of two or more parallel heat exchangers each having a warm end operating at about ambient temperature and a cold end operating at cryogenic temperatures.

According to the present invention there is provided a method of separating air, including the steps of cooling by heat exchange a stream of compressed air to reduce its temperature to a level suitable for its separation by rectification, separating the air by rectification into oxygen and nitrogen fractions, taking a stream of liquid oxygen from the oxygen fraction and a stream of nitrogen vapor from the nitrogen fraction, warming the nitrogen stream in countercurrent heat exchange with the air stream being cooled, pressurizing the liquid oxygen stream, and raising its temperature by countercurrent heat exchange with a heat exchange stream and the air stream being cooled, taking a part of the compressed air stream, expanding it with the performance of external work and introducing it into the lower pressure stage of a rectification column comprising a higher pressure stage and a lower pressure stage, wherein said heat exchange stream is formed by taking another part of the compressed air stream and further compressing it in a plurality of stages, and a portion of the compressed air undergoing further compression is taken at a pressure intermediate its pressures upstream and downstream of said further compression, is expanded with the performance of external work and is introduced into said higher pressure stage of the rectification column.

Preferably, the relative pressures to which said liquid oxygen and heat exchange streams are raised are preferably such that the lower temperature maximum on the specific enthalpy-temperature curve of the heat exchange stream is at a temperature not greater than that of the lower temperature maximum on the specific enthalpy-temperature curve of the liquid oxygen stream. Preferably, neither the heat exchange nor the said liquid oxygen stream is raised in pressure to over 100 atmospheres absolute (10 MPa).

The method according to the invention makes it possible to conduct the heat exchange of first the compressed air stream with the nitrogen stream and the liquid oxygen stream with the said heat exchange stream in the same heat exchanger or series of heat exchangers when for example producing a gaseous oxygen product at a pressure of 50 atmospheres absolute.

The invention also provides apparatus for separating air, comprising a first compressor for compressing an air stream; a main heat exchanger or series of main heat exchangers for reducing the temperature of the compressed air stream to a temperature suitable for its separation by rectification; a rectification column comprising a higher pressure stage and a lower pressure stage for separating the air into oxygen and nitrogen fractions, the higher pressure stage having an inlet for the temperature-reduced air stream; a first outlet from the lower pressure stage of the rectification column for a liquid oxygen stream; a pump having an inlet in communication with said first outlet and an outlet in communication with the cold end of said main heat exchanger or series of main heat exchangers, whereby, in operation, the oxygen stream is able to flow in countercurrent heat exchange with the air stream; a second outlet from the lower pressure stage of the rectification column for a stream of nitrogen vapor communicating with the cold end of the main heat exchanger or series of main heat exchangers; a first expansion turbine for taking a part of the compressed air stream and expanding it with the performance of external work, said first expansion turbine having an outlet in communication with an inlet to the lower pressure stage of the rectification column; a second compressor or compressors having a plurality of stages for further compressing another part of the compressed air stream and passing it through the main heat exchanger or series of main heat exchangers as a heat exchange stream countercurrently to the oxygen stream; and a second expansion turbine for the expansion of air with the performance of external work having an inlet communicating with an intermediate region of said second compressor or compressors and an outlet communicating with the higher pressure stage of the rectification column.

The main heat exchanger or the members of the series of main heat exchangers are preferably each plate-fin heat exchangers.

The two stages of the rectification column are preferably linked by a condenser-reboiler which boils oxygen in a sump of the lower pressure stage and condenses nitrogen from the higher pressure stage and returns at least part of it thereto as reflux.

Preferably, the heat exchange stream leaves the cold end of the main heat exchanger or series of main heat exchangers with a specific enthalpy and at a temperature that lie below the lower temperature maximum on the specific enthalpy-temperature curve of the stream. The heat exchange stream typically leaves the cold end of the main heat exchanger or series of main heat exchangers at a pressure above that of its point of contact (i.e. the critical point at which liquid air can exist in equilibrium with gaseous air) and is hence a super-critical fluid.

The first turbine typically takes a part of the main air stream (i.e. the stream that is not further compressed) from an intermediate region of the main heat exchanger or series of heat exchangers while the second turbine preferably takes said portion of further compressed air at a pressure in the range of 10 to 30 atmospheres absolute typically from said intermediate region of the main heat exchanger or series of main heat exchangers. Preferably, air enters each turbine at the temperature of the pinch point of the main heat exchanger or series of main heat exchangers.

Preferably the heat exchange stream is divided into two parts each of which is subjected to pressure reduction one being introduced as liquid into the lower pressure stage and the other as liquid into the higher pressure stage of the rectification column.

The method and apparatus according to the invention are particularly suited to use in producing an oxygen product containing about 95% by volume of oxygen at a pressure of about 50 atmospheres absolute.

BRIEF DESCRIPTION OF THE DRAWINGS

The method and apparatus according to the invention will now be described by way of example with reference to the accompanying drawings, in which.

DETAILED DESCRIPTION

Figure 1:
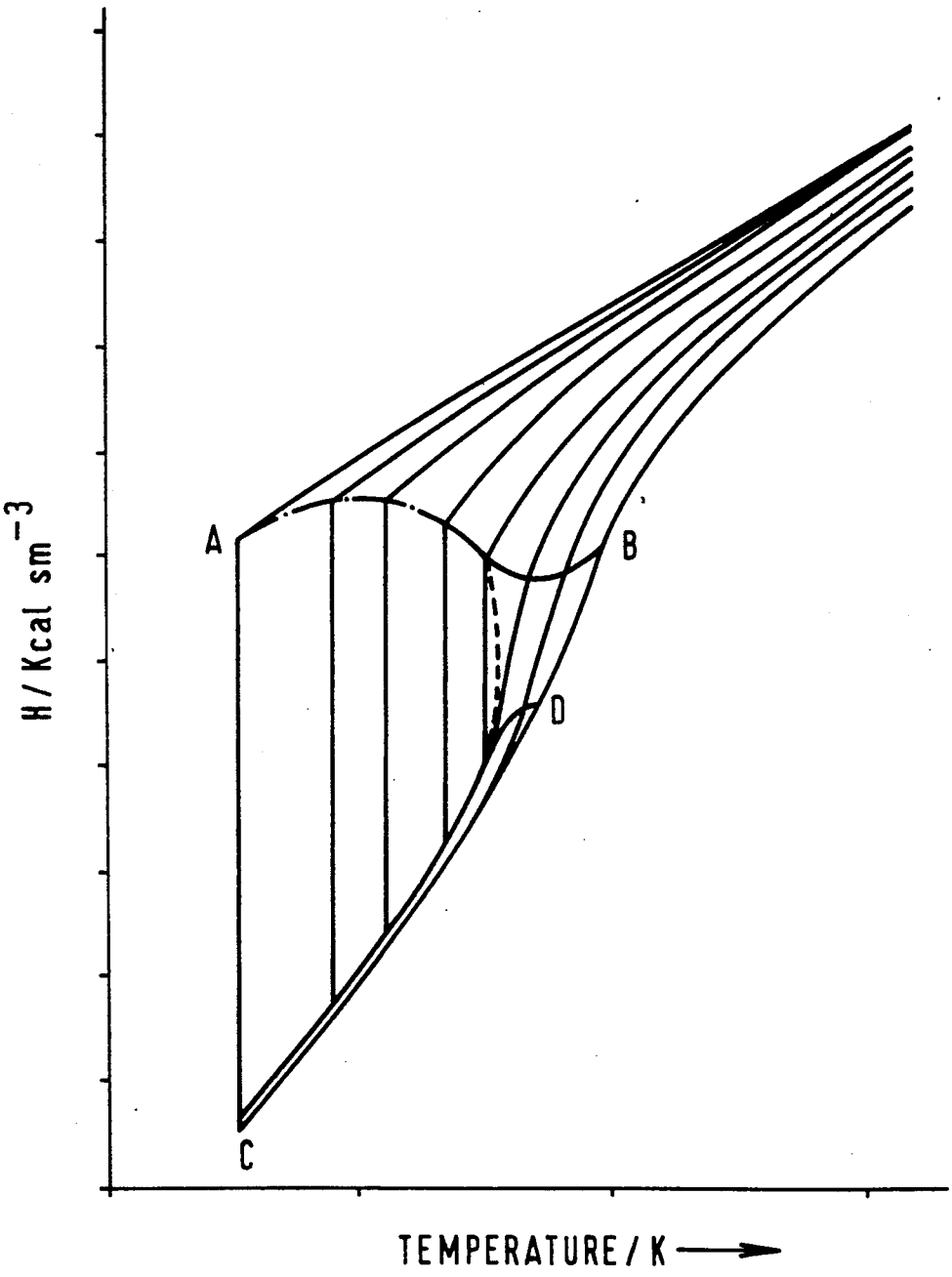
FIG. 1 is a graph showing a series of curves of the specific enthalpy against temperature plotted at different pressures for oxygen.

FIG. 1 of the drawing shows a family of specific enthalpy (enthalpy per standard cubic meter)—temperature curves for nitrogen. At a given pressure, the specific enthalpy progressively falls with decreasing temperature. Each one of the curves has two maxima, one at a higher temperature and one at a lower temperature. The higher temperature maxima of the curves lie on the line AB. The lower temperature maxima lie on the line CD. Nitrogen has a critical pressure of 33.18 bar. At a given pressure below the critical pressure, the two maxima on the specific enthalpy-temperature curve have the same temperature. In other words, the temperature-enthalpy curve is vertical between the two maxima. For a specific enthalpy-temperature curve of oxygen at a pressure below the critical pressure, its maximum lying on the line AB is the point at which gaseous nitrogen starts to liquefy and its maximum lying on the line CD is the point at which liquefaction is complete. At a pressure above the critical pressure, the maximum on the line AB is at a higher temperature than the maximum on the line CD. At above the critical pressure, there is no discrete change of phase from the gas to the liquid, but if the fluid at or below the maximum lying on the line CD is subjected to a reduction in pressure to below the critical pressure, liquid nitrogen will be produced.

A similar family of curves to that shown in FIG. 1 can be drawn for oxygen. At a given pressure, the respective maxima for oxygen occur at lower temperatures than for nitrogen, and the critical pressure of oxygen is higher (50.42 bar). A similar set of curves can also be plotted for air. The respective maxima for air also occur at lower temperatures than for air. Air does not have a single critical pressure as such. There is one temperature in pressure which is the maximum at which a vapor can exist in equilibrium with liquid air, and a slightly different critical point where a liquid can exist in equilibrium with gaseous air. The first of these points, known as the plait point, is at 37.25 bar and 132.4K, and the second, known as the point of contact, is at 132.52K and 37.17 bar. The conventional approach to setting the operating parameters of a process which produces high pressure oxygen by vaporizing liquid oxygen is to arrange for the maxima on the specific enthalpy-temperature curve of the heat exchange stream to be at higher temperatures than the respective maxima on the specific enthalpy-temperature curve of the oxygen stream. This therefore entails using a heat exchange stream of air or nitrogen at a pressure more than twice that of the oxygen stream. The processes described with respect to and shown in FIG. 2 enable oxygen to be produced at a pressure in the order of 50 atmospheres absolute without, however, necessitating the use of heat exchange stream pressures in the order of 100 atmospheres absolute.

Figure 2:
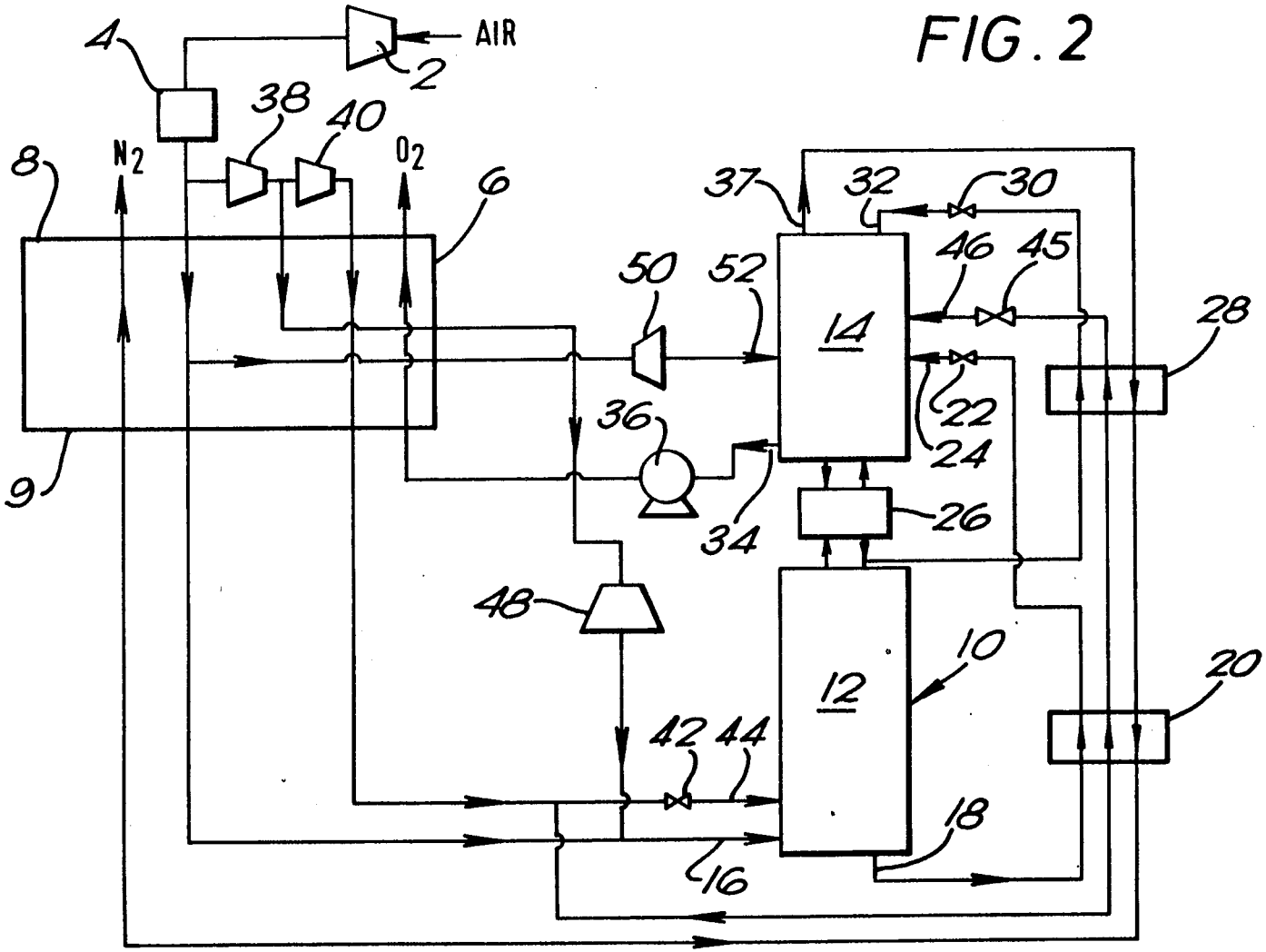
FIG. 2 is a schematic flow diagram of an air separation apparatus or plant according to the invention.

Referring now to FIG. 2 of the drawings, air is compressed in a compressor 2 having an after-cooler (not shown) to remove heat of compression. The resulting air typically at a pressure of up to 10 atmospheres absolute is then passed through a purification apparatus 4 effective to remove low volatility impurities, principally water vapor and carbon dioxide, from the incoming air. The apparatus 4 is of a kind which employs beds of adsorbent (e.g. a molecular sieve such as a synthetic or natural zeolite) to adsorb the water vapor and carbon dioxide from the air. The beds may be operated out of sequence with one another such that while one or more beds are being used to purify the air the remaining bed or beds are being regenerated, typically by means of a stream of nitrogen. The purified air flow is then divided into a major stream and a minor stream. The major stream flows through a plate-fin heat exchanger 6 from its warm end 8 to its cold end 9. The resulting air stream typically at its saturation temperature is introduced in vapor state through an inlet 16 into the higher pressure stage 12 of a rectification column 10 comprising the higher pressure stage 12 and a lower pressure stage 14. Both the stages 12 and 14 are provided with liquid-vapour contact means whereby descending liquid is brought into intimate mass-transfer relationship with ascending vapor. The liquid-vapour contact means may for example comprise liquid-vapour contact trays or structured packing.

In the higher pressure stage 12 of the rectification column 10, the air is separated into a nitrogen fraction and an oxygen-enriched air fraction. As the vapor ascends the higher pressure stage 12 so it becomes progressively richer in nitrogen through its mass transfer relationship with descending liquid. The descending liquid becomes progressively richer in oxygen. A liquid oxygen-enriched air stream is withdrawn from the higher pressure stage 12 through an outlet 18, is sub-cooled in a plate-fin heat exchanger 20, and then flows through a pressure reducing valve 22. The valve 22 is effective to reduce the pressure of the sub-cooled, liquid, oxygen-enriched air stream to the pressure of the lower pressure stage 14 (which is typically in the order of 1.3 to 1.5 atmospheres absolute). The liquid air stream is introduced into the lower pressure stage 14 through an inlet 24. The air is separated in the stage 14 into oxygen and nitrogen fractions by virtue of mass transfer between a descending liquid and an ascending vapor phase.

There is a condenser-reboiler 26 that links thermally the stages 12 and 14 of the rectification column 10. The condenser-reboiler 26 reboils the liquid oxygen of the lower pressure stage 14 by heat exchange with nitrogen vapor from the higher pressure stage 12, the nitrogen vapor being itself condensed. Accordingly, an upward flow of vapor through the stage 14 is provided. Part of the condensed liquid nitrogen is returned to the higher pressure stage 12 and provides reflux for it, while the remainder is sub-cooled in a plate-fin heat exchanger 28, is passed through a pressure reduction valve 30 so as to reduce its pressure to that of the lower pressure stage 14, and is then introduced as reflux into the top of the stage 14 through an inlet 32.

A stream of liquid oxygen is withdrawn from the lower pressure stage 14 of the rectification column 10 through an outlet 34 by means of a pump 36 which is effective to raise its pressure to a chosen value typically in the order of 50 atmospheres absolute. The resulting pressurized oxygen stream then flows through the heat exchanger 6 from its cold end 9 to its warm end 8 and leaves the heat exchanger 6 as a gaseous stream at approximately ambient temperature. During this passage, the oxygen stream vaporized at a temperature of 152 to 156K. A stream of nitrogen vapor is withdrawn from the lower pressure stage 14 of the rectification column 10 through an outlet 37, is passed through the heat exchangers 28, 20 and 6 in sequence, each from its warm end to its cold end, and is thereby warmed to ambient temperature. It may be taken as a product or vented as a waste stream.

The aforesaid minor air stream is used to meet some of the refrigeration requirements of the process and to help maintain a relatively close match between the specific enthalpy-temperature curve of the streams being cooled in the heat exchanger 6 and that of the streams being warmed by passage therethrough. The minor air stream is first raised to an intermediate pressure typically in the order of 10 to 30 atmospheres by compression in a compressor 38 provided with an after cooler (not shown) to remove its heat of compression. A part of the resulting air stream is then compressed typically to a pressure in the order of 60 atmospheres absolute in a compressor 40 having an after cooler (not shown) to remove the heat of compression. The resulting high pressure air stream then flows through the heat exchanger 6 from its warm end 8 to its cold end 9. This high pressure air stream functions as a heat exchange stream helping to maintain the aforesaid close match between the specific enthalpy-temperature profiles of the streams being warmed in the heat exchanger 6 with those being cooled and leaves the heat exchanger at a temperature below that of the lower temperature maximum on its specific enthalpy-temperature curve. ('Condensation' of this air stream takes place between 148 and 135K.) The high pressure air stream leaving the cold end 9 of the heat exchanger 6 is then divided into two subsidiary streams. One subsidiary stream flows through one or more pressure reducing valves 42 to reduce its pressure to that of the higher pressure stage 12 of the rectification column 10. The air stream thus leaves the valve 42 as a liquid and flows into the higher pressure stage 12 through an inlet 44 typically located at a level above that of the inlet 16. The other subsidiary stream flows through the heat exchangers 20 and 28 in which it is sub-cooled. It then passes through one or more pressure reduction valves 45 and enters the lower pressure stage 14 of the rectification column 10 as a liquid through an inlet 46. Dividing the liquid air in this way between the higher pressure stage 12 and the lower pressure stage 14 of the rectification column 10 helps to make possible operation of the lower pressure stage 14 at minimum reflux conditions and thus helps to keep down the power consumption of the plant.

Figure 3:
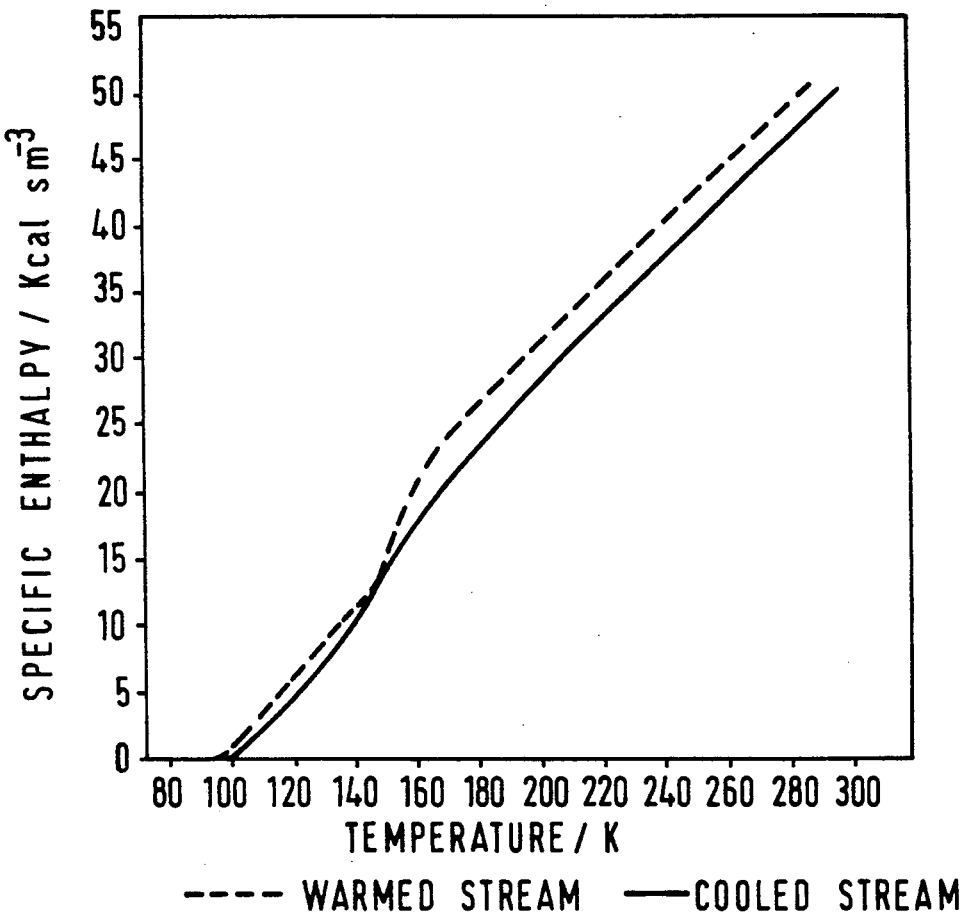
FIG. 3 is a specific enthalpy-temperature graph illustrating operation of the apparatus shown in FIG. 2.

Refrigeration requirements of the plant are met by operation of expansion turbines 48 and 50. The turbine 48 receives that part of the air flowing from the compressor 38 that does not enter the compressor 40. Such part of the air flow passes from the warm end 8 of the heat exchanger 6 to an intermediate region thereof, from which region it is withdrawn and then expanded in the expansion turbine 48. The resulting expanded air stream is united with the air stream entering the higher pressure stage 12 of the rectification column 10 through the inlet 16. The turbine 50 receives a portion of the major air flow from the purification apparatus 4. This portion is withdrawn therefrom at an intermediate region of the heat exchanger 6 and is expanded in the turbine 50 to the operating pressure of the lower pressure stage 14 of the rectification column 10. It is then introduced into the lower pressure stage 14 through an inlet 52. The region of the heat exchanger 6 from which the streams for expansion in the turbines 48 and 50 are withdrawn is preferably at the pinch point temperature of this heat exchanger 6. Accordingly, there is a particularly close match between the specific enthalpy-temperature curve of the streams being cooled in the heat exchanger 6 with that of the streams being warmed therein, as is shown in FIG. 3.

In a typical example of the operation of the plant shown in FIG. 6, the compressor 2 has an outlet pressure of 5.5 atmospheres, the compressor 38 an outlet pressure of 23 atmospheres absolute, and the compressor 40 an outlet pressure of 60 atmospheres absolute. In order to produce 200 tonnes per day of oxygen of 95% purity at a pressure of 50 atmospheres absolute, the total air flow is 30,500 $sm^3/hr$, of which 12,270 $sm^3/hr$ flows through the compressor 88 and 8920 $sm^3/hr$ flows through the compressor 40.

If desired, one of the turbines 48 and 50 may be arranged to drive one of the compressors 38 and 40, and the other of the turbines 48 and 50 may be arranged to drive the other of the compressors 38 and 40.

I claim:

1. A method of separating air including: compressing and purifying the air to form a stream of compressed air; dividing the stream of compressed air into first and second subsidiary streams; cooling the first and second subsidiary streams in a main heat exchanger to reduce their temperature to a level suitable for their separation by rectification; separating the air into oxygen and nitrogen fractions by introducing the first and second subsidiary streams into a higher pressure stage of a rectification column comprising the higher pressure stage and a lower pressure stage; taking a stream of liquid oxygen from the oxygen fraction and a stream of nitrogen vapor from the nitrogen fraction; warming the stream of nitrogen vapor within the main heat exchanger in countercurrent heat exchange with the subsidiary streams being cooled; withdrawing a part of the first subsidiary stream from the main heat exchanger intermediate its cold and warm ends, expanding it with the performance of external work, and introducing it into the lower pressure stage of the rectification column; upstream of the cooling of the second subsidiary stream, compressing the second subsidiary stream and further compressing it in a plurality of stages; pressurizing the liquid oxygen stream, and raising its temperature by countercurrently heat exchanging it within the main heat exchanger with the subsidiary streams; taking a portion of the second subsidiary stream upstream of the further compression thereof, expanding the portion of the second subsidiary stream with the performance of external work, and introducing the portion of the second subsidiary stream into said higher pressure stage of the rectification column.

2. The method as claimed in claim 1, in which the relative pressures to which said stream of the liquid oxygen stream and the second subsidiary stream are raised are such that the lower temperature maximum on the specific enthalpy-temperature curve of said second subsidiary stream is at a temperature not greater than that of the lower temperature maximum on the specific enthalpy-temperature curve of said stream of the liquid oxygen.

3. The method as claimed in claim 1, in which the second subsidiary air stream leaves the cold end of the main heat exchanger with a specific enthalpy and at a temperature that lies below the lower temperature maximum on the specific enthalpy-temperature curve of said second subsidiary stream.

4. The method as claimed in claim 1, in which second part of the first subsidiary stream and said portion of the second subsidiary air stream are each withdrawn from the same intermediate region of the main heat exchanger.

5. The method as claimed in claim 4, wherein the intermediate region is at a pinch point of the main heat exchanger.

6. The method as claimed in claim 1, wherein the second subsidiary stream is liquefied by pressure reduction after having been cooled in the main heat exchanger and is divided into two parts and wherein one of the two parts is introduced into the higher pressure stage of the rectification column and the other of the two parts is introduced into the lower pressure stage of the rectification column.

7. An apparatus for separating air comprising: a first compressor for compressing the air; purification means for purifying the air; dividing means communicating with the purification means for dividing the air into first and second subsidiary streams; main heat exchange means for reducing the temperature of the first and second subsidiary streams to a level suitable for for their separation by rectification; a rectification column comprising a higher pressure stage and a lower pressure stage for separating the air into oxygen and nitrogen fractions, the higher pressure stage having an inlet communicating with the main heat exchange means so as to receive the first subsidiary stream, the lower pressure stage having a first outlet for discharging a liquid oxygen stream composed of the oxygen fraction; a pump providing communication between the first outlet of the lower pressure stage and the main heat exchange means such for passing the liquid oxygen stream in countercurrent heat exchange with the second subsidiary stream; the lower pressure stage of the rectification column also having a second outlet communicating with the main heat exchange means for enabling a nitrogen vapor stream to flow from the lower pressure stage through the main heat exchange means in countercurrent heat exchange with the subsidiary streams; a first expansion turbine having an inlet communicating with the main heat exchange means and an outlet in communication with the inlet of the higher pressure stage of the rectification column such that, in use, a part of the first subsidiary air streams is expanded with the performance of external work upstream of its introduction into said higher pressure stage; a plurality of second compression stages communicating at their inlet with the dividing means and at their outlet with the main heat exchange means such that, in use, the second subsidiary stream is further compressed upstream of being cooled; and a second expansion turbine for the expansion of air with the performance of external work having an inlet communicating via said heat exchange mass with an intermediate region of said plurality of said second compression stages and an outlet communicating with the higher pressure stage of the rectification column, such that in use a portion of the second air stream is expanded is cooled in the main heat exchange means and flows into the higher pressure stage.

8. The apparatus as claimed in claim 7, wherein the first and second expansion turbines communicate with the main heat exchange means at an intermediate region thereof.

* * * * *